US012428202B2

(12) United States Patent
Viale et al.

(10) Patent No.: US 12,428,202 B2
(45) Date of Patent: Sep. 30, 2025

(54) RECYCLABLE CLOSURE

(71) Applicant: Guala Closures S.p.A., Alessandria (IT)

(72) Inventors: Luca Viale, Alessandria (IT); Fulvio Bosano, Alessandria (IT); James Andrew Oldfield, Aberdour Burntisland Fife Scotland (GB)

(73) Assignee: Guala Closures S.p.A., Alessandria (IT)

( * ) Notice: Subject to any disclaimer, the term of this patent is extended or adjusted under 35 U.S.C. 154(b) by 0 days.

(21) Appl. No.: 18/689,456

(22) PCT Filed: Sep. 6, 2022

(86) PCT No.: PCT/EP2022/074772

§ 371 (c)(1),
(2) Date: Mar. 6, 2024

(87) PCT Pub. No.: WO2023/036789

PCT Pub. Date: Mar. 16, 2023

(65) Prior Publication Data

US 2025/0033834 A1 Jan. 30, 2025

(30) Foreign Application Priority Data

Sep. 9, 2021 (IT) ..... 102021000023294

(51) Int. Cl.
*B65D 39/16* (2006.01)

(52) U.S. Cl.
CPC ..... *B65D 39/16* (2013.01); *B65D 2565/385* (2013.01)

(58) Field of Classification Search
CPC ..... B65D 39/16; B65D 39/0052; B65D 39/0058; B65D 41/28; B65D 51/24;

(Continued)

(56) References Cited

U.S. PATENT DOCUMENTS 332,382 A * 12/1885 Glough ..... B65D 39/16 215/354
809,213 A * 1/1906 Osgood ..... B65D 41/62 215/251

(Continued)

FOREIGN PATENT DOCUMENTS

FR 2971767 8/2012
WO WO 2008019443 2/2008
WO WO-2021089889 A1 * 5/2021 ..... B65D 39/0058

OTHER PUBLICATIONS

Partial search report dated Dec. 12, 2022; Application No. PCT/EP2022/074772 ; 13 pages.

(Continued)

*Primary Examiner* — Orlando E Aviles
*Assistant Examiner* — Brijesh V. Patel
(74) *Attorney, Agent, or Firm* — Erik J. Overberger; Rankin, Hill & Clark LLP

(57) ABSTRACT

A closure (10) for a container (1) having a neck (2) with a pouring opening (4), comprising a plug (20) configured to engage within the neck to close the pouring opening, an overcap (30) attached to the plug (20), wherein the overcap (30) comprises a first part (40) removably attached to the plug (20), a second part (50) configured to be grasped for opening and closing the container, the second part (50) comprising a tear off seal (51) configured to pass from a first configuration to a second configuration wherein, in the first configuration, the second part (50) acts on the first part (20) to secure attachment of the first part (40) to the Plug (20) and, in the second configuration, the second part (50) is releasable from the first part (40) so that the first part (40) is separable from the plug (20).

10 Claims, 7 Drawing Sheets

(58) Field of Classification Search
CPC .... B65D 2251/0015; B65D 2251/0075; B65D 2251/0078; B65D 2251/009; B65D 2565/385; A47J 41/0011
USPC ..... 215/364, 300, 354–355, 249, 296, 247, 215/261, 294, 305, 320, 43
See application file for complete search history.

(56) References Cited

U.S. PATENT DOCUMENTS 2,249,022 A * 7/1941 Merolle ..... B65D 39/16 215/364
2,641,375 A * 6/1953 Steuart ..... B65D 39/16 215/364
3,559,834 A * 2/1971 Taylor ..... B65D 41/58 215/354
4,106,656 A * 8/1978 Babiol ..... B65D 39/16 222/563
5,209,362 A * 5/1993 Lutzker ..... B65D 51/20 220/729
5,678,718 A * 10/1997 Morris ..... B65D 45/322 220/309.1
5,803,285 A * 9/1998 Hirota ..... B65D 39/16 81/3.15
5,957,314 A * 9/1999 Nishida ..... B65D 45/322 220/257.1
7,845,505 B2 * 12/2010 Hamamoto ..... B65D 41/28 215/280
8,567,621 B2 * 10/2013 Chae ..... B65D 45/322 220/254.1
9,114,912 B2 * 8/2015 Giovannini ..... B65D 39/0052
10,479,561 B2 * 11/2019 Nakatani ..... B65D 51/002
10,899,511 B2 * 1/2021 Showering ..... B65D 51/1677
2008/0308519 A1 * 12/2008 Farrar ..... B65D 51/145 215/44
2010/0258522 A1 * 10/2010 Escobar ..... B65D 39/16 215/364
2019/0283944 A1 * 9/2019 Giovannini ..... B65D 39/16
2021/0107704 A1 * 4/2021 Rossi ..... B65D 41/28

OTHER PUBLICATIONS

International search report and written opinion dated Mar. 15, 2023; Application No. PCT/EP2022/074772 ; 15 pages.

* cited by examiner

RECYCLABLE CLOSURE

FIELD OF THE INVENTION

The present invention relates to a closure for containers.

DISCUSSION OF THE RELATED ART

Closures for containers are known in the art.

WO 2018/193422 discloses a closure comprises a cylindrical element having a first portion and a second portion, the latter being adapted to engage, as a removable cap, in a portion of a neck of a container, an overcap attached to the cylindrical element, comprising a first body and a second body, attached together and defining a seat. The cylindrical element is partially disposed in the seat to be locked within the seat.

WO 2021/111375 discloses a stopper configured to be placed on a bottle neck, comprising a support element which has a top edge and a bottom edge and which extends along a center axis; a ring portion which fits on the support element and which extends from the top edge to the bottom edge, rotationally locked with respect to the support element; a cover element, which is coupled to the support element at the top edge and is connected to ring portion; the ring portion is locked along the center axis by the support element and by the cover element.

ES 2789151 discloses a recyclable cap for containers, comprising an outer body and an inner body provided with fixing means for retention in a container, the inner body being coupled and housed inside said outer body. The outer body is made of a biodegradable material of plant origin, and the outer body and the inner body are coupled by coupling means configured to link both two bodies from one another. The inner body including a single-use release system configured to separate the outer body from the inner body. In this way, after the end of its useful life, the user will have the ability to separate and recycle the outer body and the inner body in a completely independent way.

Prior Art Problem

The above mentioned closures cannot be recycled in an easy manner after their use and require substantive operations of the user for separation of their component.

SUMMARY OF THE INVENTION

Therefore, the purpose of the present invention is to provide a closure that can overcome the aforementioned prior art drawbacks.

In particular, the object of the present invention is to provide a closure that allows a user to easily separate the component thereof.

Advantages of the Invention

The above object is achieved with the closure according to the appended claims.

BRIEF DESCRIPTION OF THE DRAWINGS

The characteristics and advantages of the present invention will result from the following detailed description of a possible practical embodiment, illustrated as a non-limiting example in the annexed drawings, in which.

DETAILED DESCRIPTION

Figure 1:
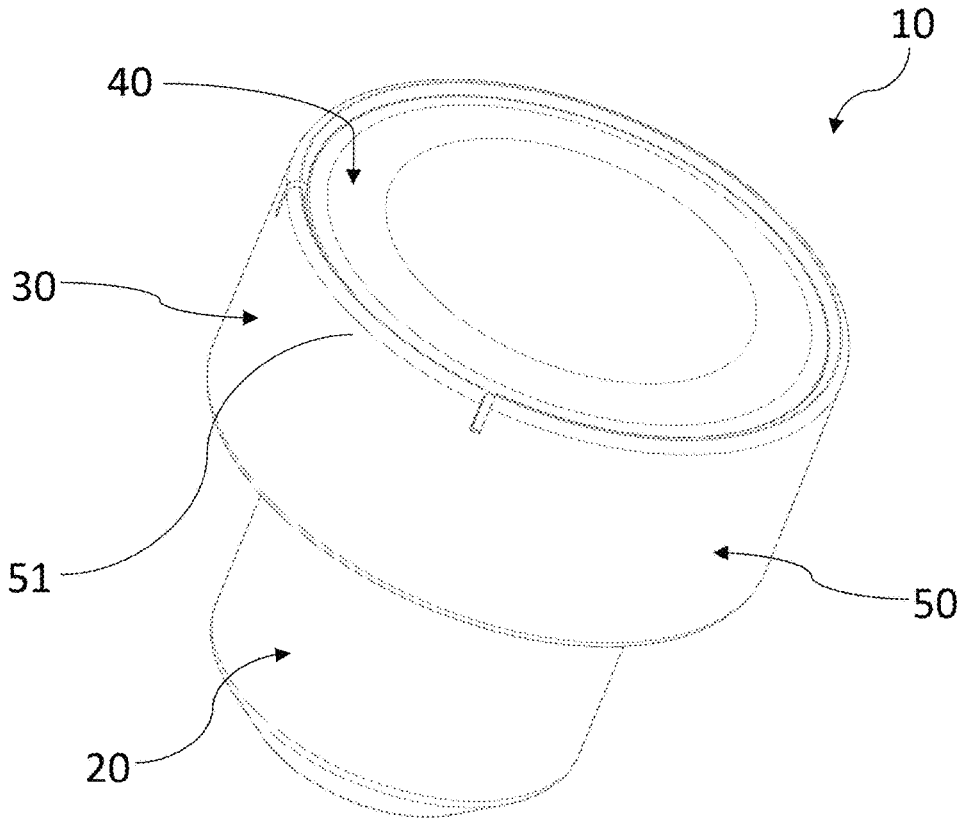
FIG. 1 shows a perspective view of a closure according to one embodiment of the present invention.
Figure 2:
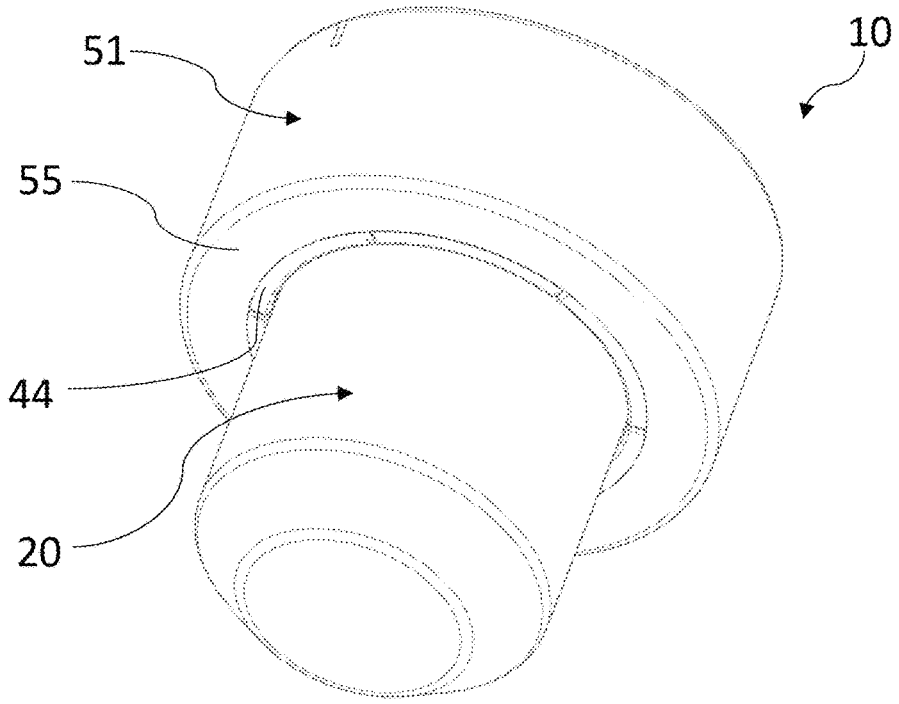
FIG. 2 shows a different perspective view of the closure of FIG. 1.
Figure 3:
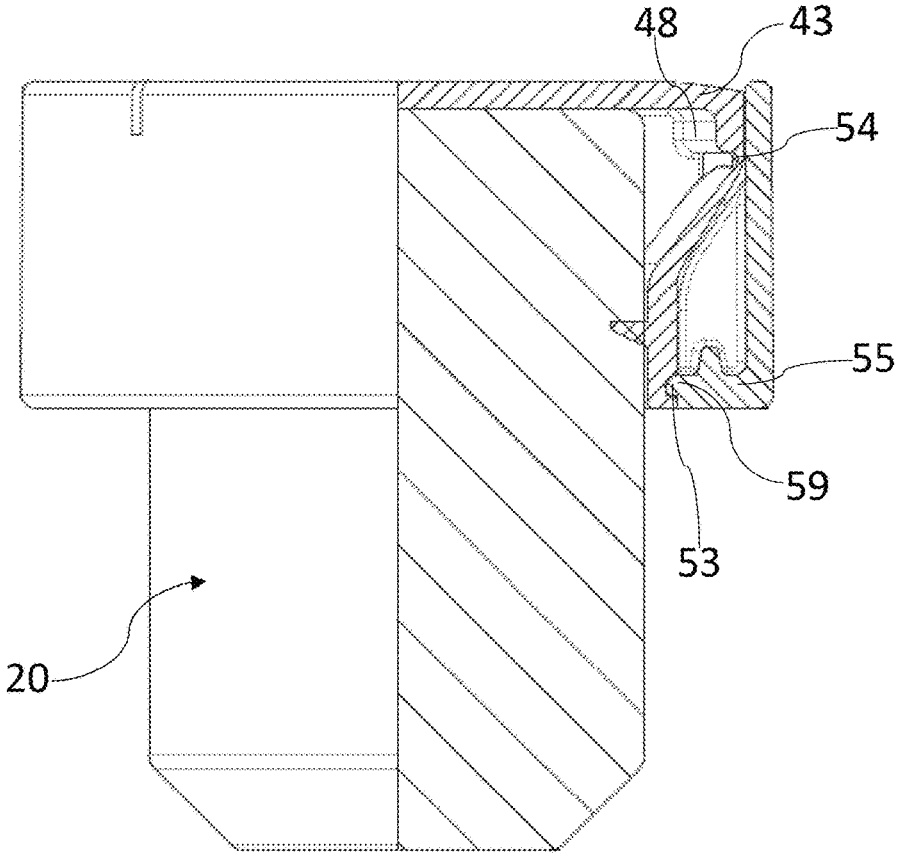
FIG. 3 shows a sectional view of the closure of FIG. 1.
Figure 4:
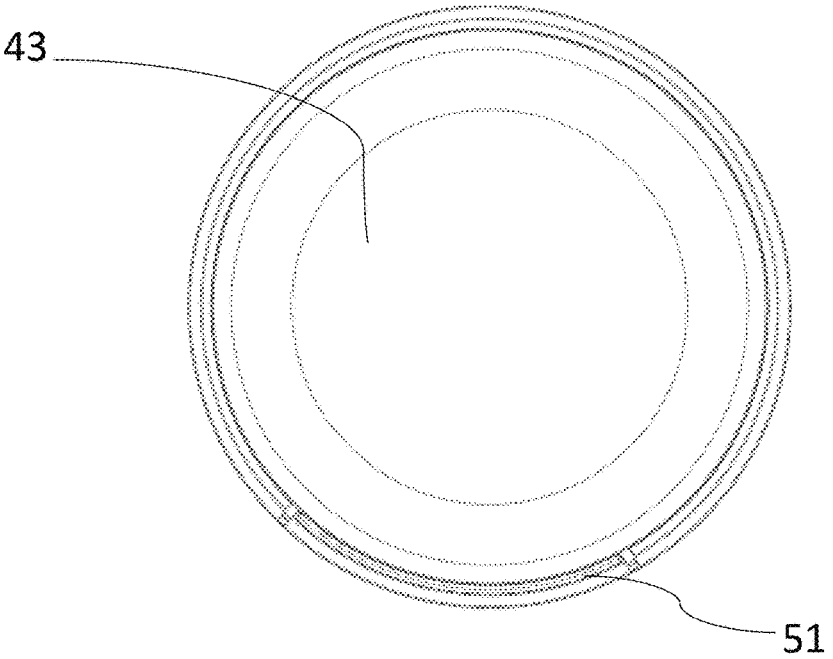
FIG. 4 shows a top view of the closure of FIG. 1, FIGS. 5 and 6 show perspective views of the second part of the closure of FIG. 1, FIGS. 7 and 8 show perspective views of the first part of the closure of FIG. 1, FIGS. 9 and 10 show perspective views of steps for assembling the closure of FIG. 1, FIGS. 11, 12 and 13 show perspective views of steps for disassembling and separating the second part, the first part and the plug of the closure of FIG. 1.
Figure 5:
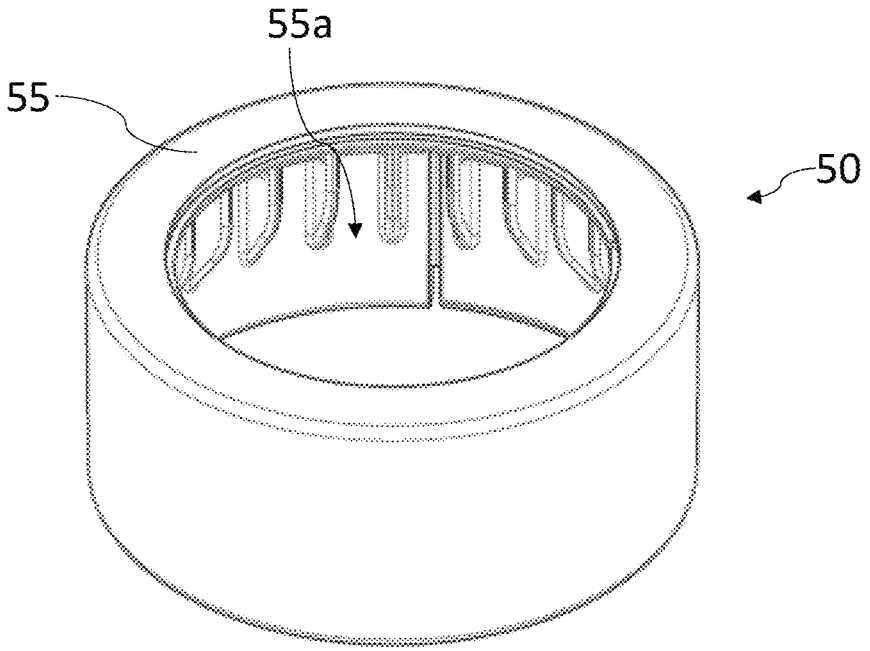
Figure 6:
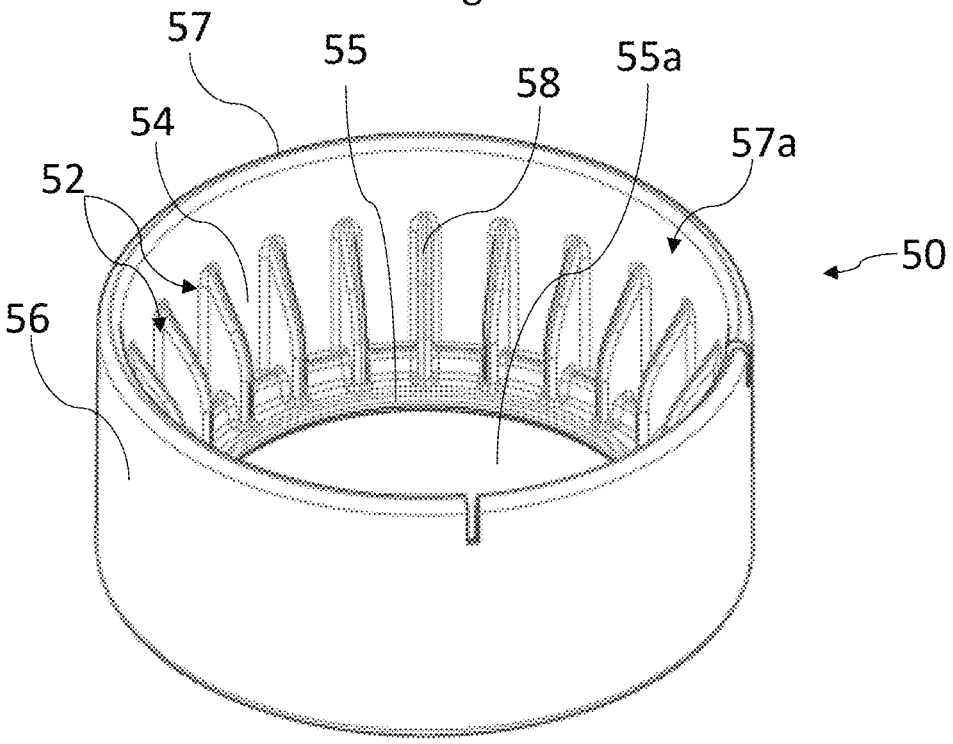
Figure 7:
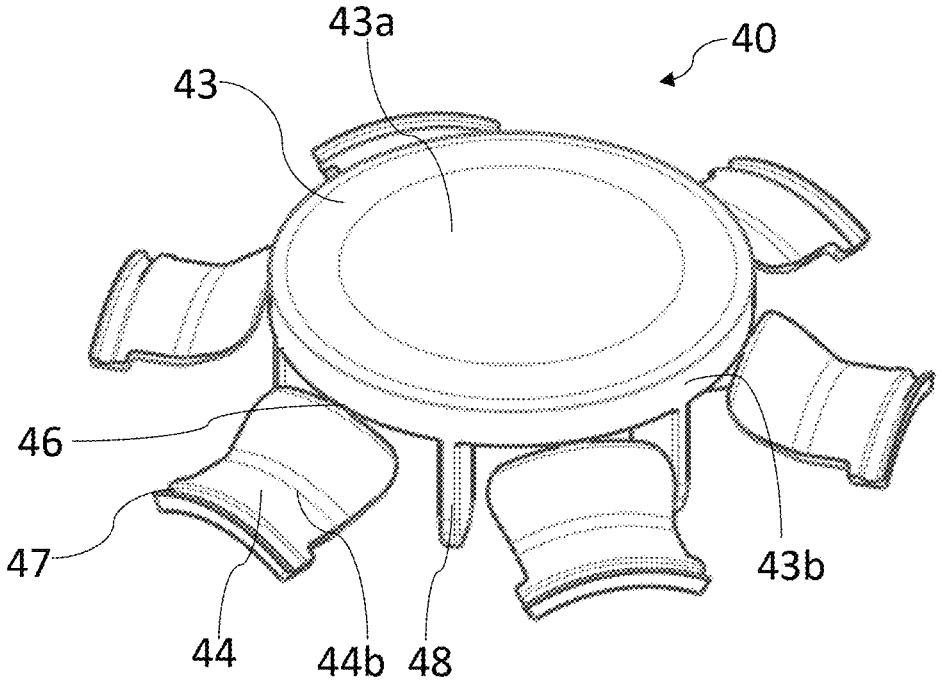
Figure 8:
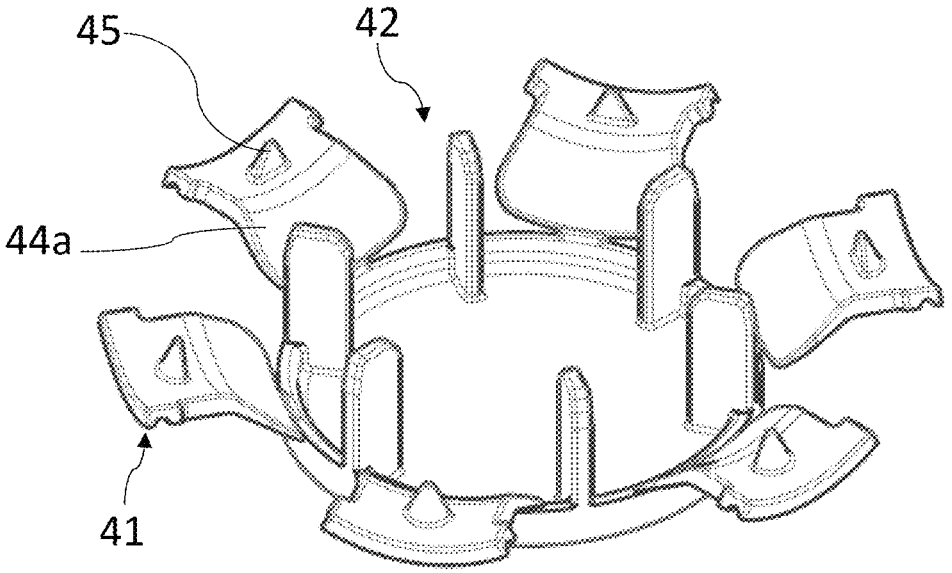
Figure 9:
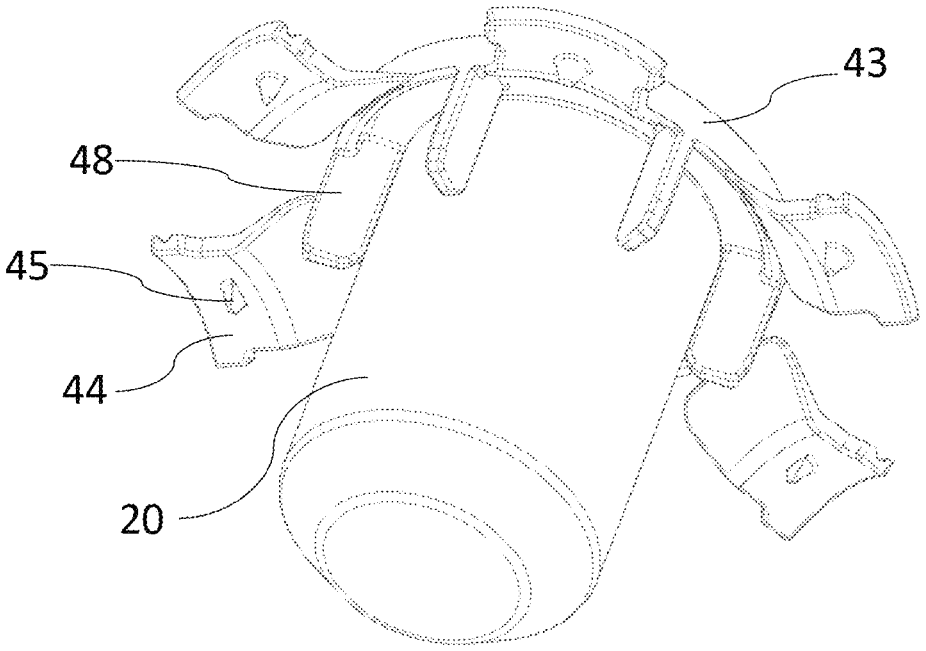
Figure 10:
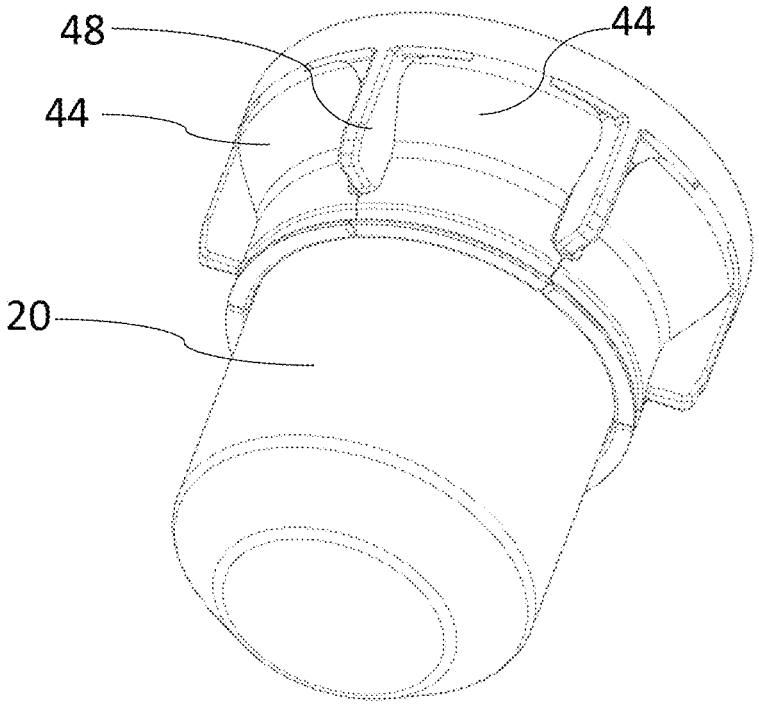
Figure 11:
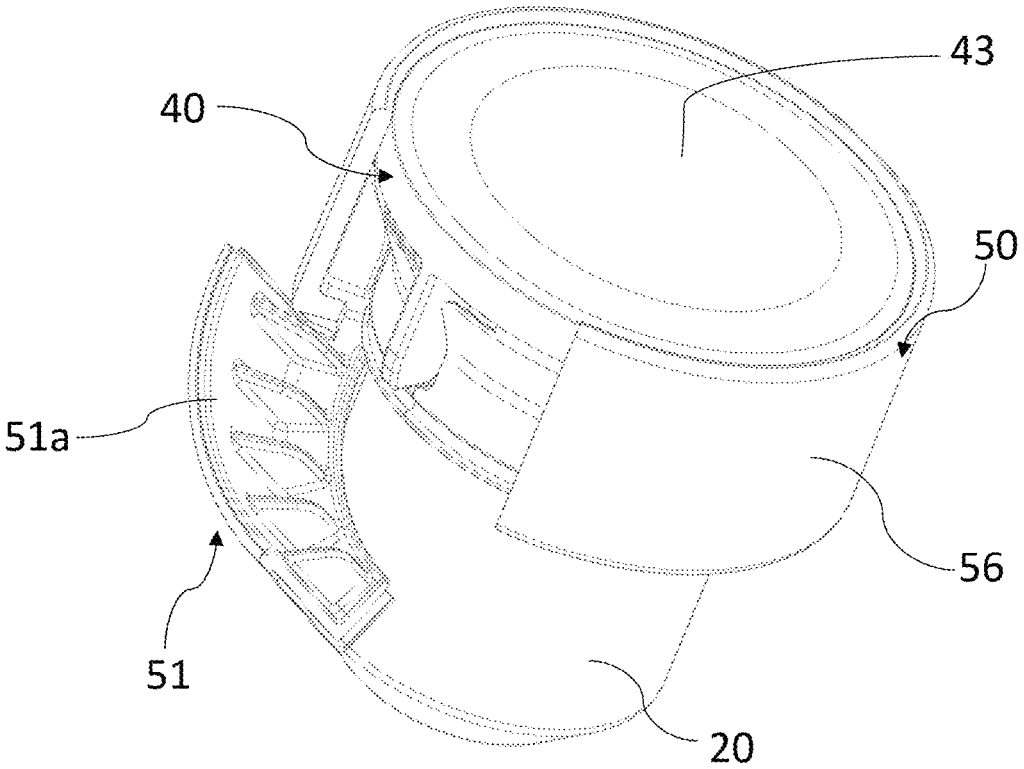
Figure 12:
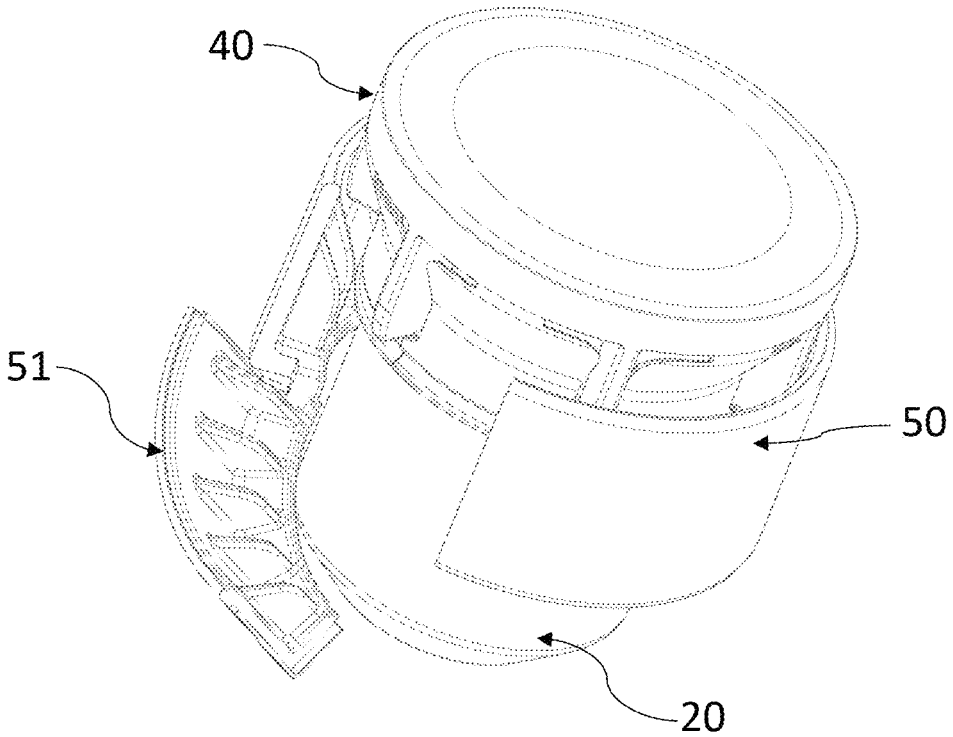
Figure 13:
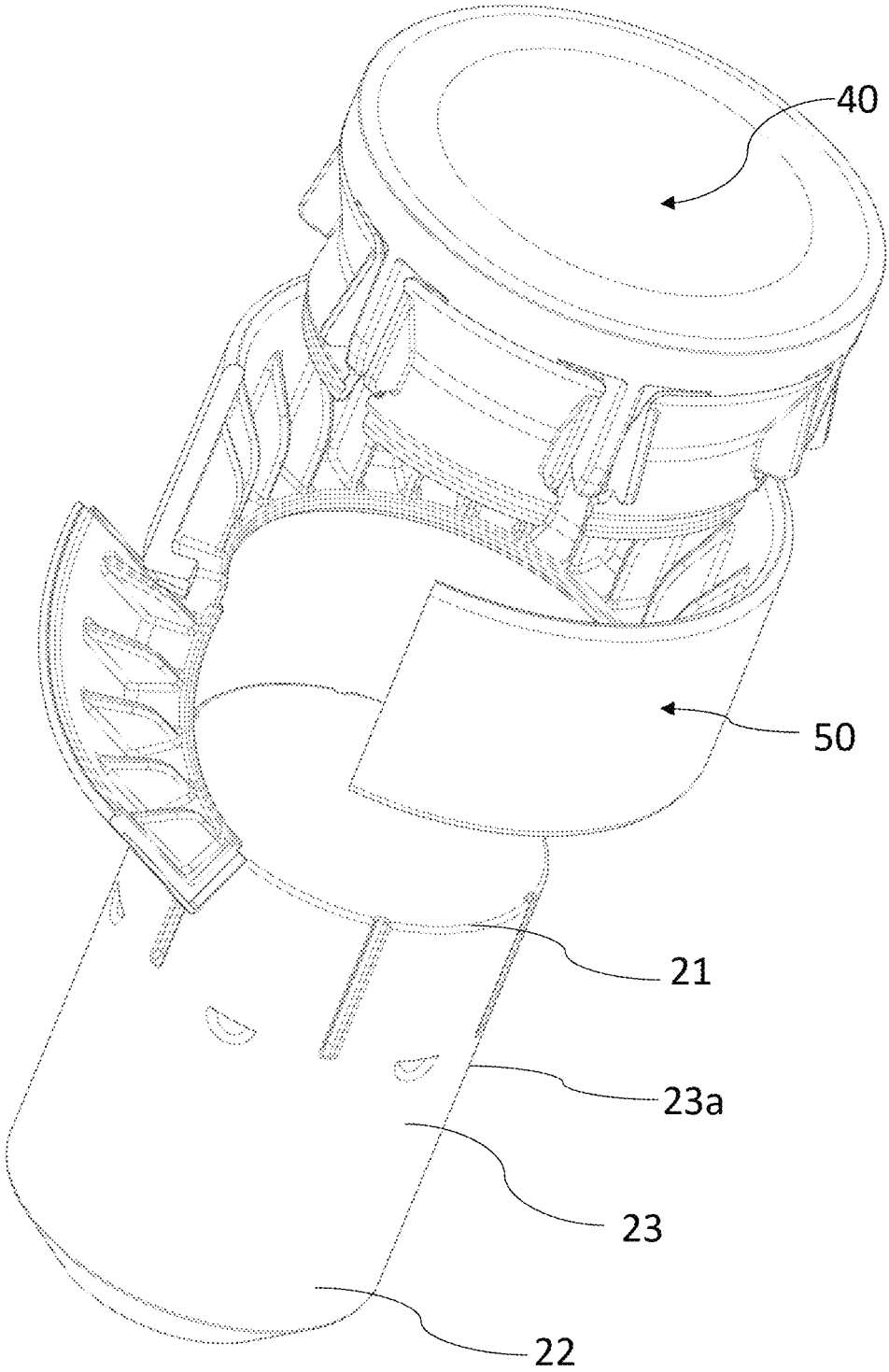

Even when this is not expressly stated, the individual features as described with reference to the particular embodiments shall be intended as auxiliary to and/or interchangeable with other features described with reference to other exemplary embodiments.

Referring to the accompanying figures, the present invention relates to a closure 10, which is configured to be placed on a neck 2 of a container 1.

The container 1 has a body 3 and the neck 2 extends from the body 3 and has a pouring opening 4 at a free end thereof.

The closure 10 comprises a plug 20 configured to engage removably within a portion of the neck 2 through the pouring opening 4 to close and open the pouring opening 4.

The plug 20 can be made of cork or synthetic material. The plug 20 extends along an axial direction X-X and, preferably, is a cylindrical element.

The plug 20 has a top portion 21, a bottom portion 22 and a middle portion 23 arranged between the top portion 21 and the bottom portion 22. The bottom portion 22 is the portion of the plug 20 which is configured to engage removably within the neck 2 of the container 1 to seal/unseal the container 1.

An overcap 30 is associated to the plug 20. The over cap 30 comprises a first part 40 and a second part 50.

The first part 40 is removably attached to the plug 20. The second part 50 is associated to the first part 40 and is configured to be grasped for opening and closing the container 1.

The second part 50 comprise a tear off seal 51 configured to pass from a first configuration, before it is torn off, to a second configuration, once it is torn off.

In the first configuration, the second part 50 acts on the first part 40 to secure attachment of the first part 40 to the plug 20 thereby preventing separation of the first part 40 from the plug 20.

In the second configuration, the second part 50 is releasable from the first part 40 so that the first part 40 is separable from the plug 20. In particular, in the second configuration, once the second part 50 is released from the first part 40, the action of the second part 50 on the first part 40 is released as well. By this way, the first part 40 can be separated from the plug 20 since no forces act on the first part 40 to urge the first part 40 to remain attached to the plug 20.

It is worthwhile to note that, before first opening of the container, the tear off seal 51 is in the first configuration and remains in the first configuration after first opening of the container. Therefore, the tear off seal 51 remains intact upon first opening of the container. In other words, the tear off seal 51 does not identify a tamper evident for the closure.

Hereinafter, the first part 40 and the second part 50 are described with reference to the first configuration.

Preferably, the first part 40 comprises axial attachment members 41 configured to engage with the plug 20 to constrain the first part 40 to the plug 20 along the axial direction X-X and rotational attachment members 42 configured to engage with the plug 20 to constrain the first part 40 to the plug 20 rotationally around an axis X extending along the axial direction X-X.

Once the tear off seal 51 is torn off, action of the second part 50 on the first part 40 is released, in particular action of the second part 50 on the axial attachment members 41 and the rotational attachment members 42 is released.

In the embodiment shown in the figures, the first part 40 comprises a top member 43 surrounding the top portion 21 of the plug 20. In this embodiment, the axial attachment members 41 and the rotational attachment members 42 project from the top member 43 along the axial direction X-X and surround the middle portion 23 of the plug 20.

Preferably, the top member 43 comprises a top wall 43*a* and an annular wall 43*b* perpendicular to the top wall 43*a* and extending from the top wall 43*a* along the axial direction X-X. The top wall 43*a* abuts against the top surface of the top portion 21 of the plug 20 while the annular wall 43*b* fits around the side surface of the top portion 21 of the plug 20.

According to one embodiment, the axial attachment members 41 comprise tabs 44 attached to the top member 43 and arranged angularly spaced part along the top member 43.

Each tab 44 has an inner surface 44*a* and an opposite outer surface 44*b*. The inner surface 44*a* faces towards the plug 20 while the outer surface 44*b* faces towards the second part 50.

Each tab 44 comprises a protrusion 45 configured to penetrate at least partially into a portion of the side surface of the plug 20, in particular into a portion of the side surface 23*a* of the middle portion 23 of the plug 20. The protrusion 45 is formed on the inner surface 44*a* of tab 44.

Each tab 44 is attached to the top member 43 through a hinge portion 46 which allows the tab 44, in the second configuration, to be moved away from the side surface 23 of the plug 20 so that the protrusion 45 disengages from the plug 20, thereby releasing the axial constrain with the plug 20.

According to one embodiment, the tab 44 has elastic properties and, in the second configuration, it can be bent away from the plug 20.

The rotational attachment members 42 comprise axial ribs 48. The axial ribs 48 are attached to the top member 43 and arranged angularly spaced part along the top member 43.

According to the embodiment shown in the figures, the tabs 44 are interleaved with the axial ribs 48 so that an axial rib 48 is arranged between two adjacent tabs 44.

Each axial rib 48 is configured to engage with a side portion of the plug 20, in particular with a portion of the side surface 23*a* of the middle portion 23 of the plug 20.

According to one embodiment, the second part 50 comprises axial securing members 59 and rotational securing member 52.

In the first configuration, the axial securing members 59 are configured to act on the axial attachment members 41 to secure the axial attachment members 41 to the plug 20 while the rotational securing members 52 are configured to act on the rotational attachment members 42 to secure the rotational attachment members 42 to the plug 20.

According to one embodiment, the axial securing members 59 comprise annular rib portions 53 configured to act, in the first configuration, on annular groove portions 47 formed on the 44 tabs. Preferably, the annular groove portions 47 are formed on the outer surface 44*b* of the tabs 44, preferably at a position corresponding substantially to the position where the protrusions 45 are formed on the inner surface 44*a* of tab 44. According to one embodiment, the rotational securing members 52 comprise tubular wall portions 54 configured to engage, in the first configuration, with the axial ribs 48.

Preferably, the second part 50 comprises a bottom annular wall 55 defining a bottom opening 55*a* and a tubular wall 56 perpendicular to the bottom annular wall 55 and extending from the bottom annular wall 55 along the axial direction X-X to a free edge 57 defining a top opening 57*a*, Preferably, the tubular wall portions 54 are portions of the tubular wall 56 and the annular rib portions 53 are formed on the bottom annular wall 55.

According to one embodiment, the tear off seal 51 comprises at least one tear off tab, in this example the tear off tab 51*a*, formed on the tubular wall 56 for removing the second part 50 once it has been torn off.

The second part 50 comprises also attachment members for attaching axially and rotationally the second part 50 to the first part 40 so that a user is able to grasp the second part 50 for opening and closing the container. These attachment members comprise the annular rib portions 53 configured to engage with the annular groove portions 47 to attach axially the second part 50 and the first part 40 and ribs 58 protruding from the inner surface of the tubular wall 56 and configured to engage with the axial rib 48 to attach rotationally the second part 50 and the first part 40.

Once the tear off seal 51 is torn off, action of the axial securing member 59 on the axial attachment members 41 and action of the rotational securing member 52 on the rotational attachment embers 42 is released.

According to one embodiment, the first part 40 surrounds at least a portion of the plug 20 and the second part 50 surrounds at least a portion of the first part 40.

In the embodiment shown in the figures, the first part 49 is separated from the second part 40. Alternatively, the first part 40 and the second part 50 may form a one piece element and, preferably, upon tearing off the tear off seal 51, the second part 50 separates from the first part 40.

The invention claimed is:

1. A closure for a container having a neck with a pouring opening, the closure comprising:

a plug configured to engage within the neck to close the pouring opening, the plug extending along an axial direction, an overcap attached to the plug, wherein the overcap comprises:

a first part removably attached to the plug, a second part associated to the first part and configured to be grasped for opening and closing the container, the second part comprising a tear off seal configured to pass from a first configuration, before the tear off seal is torn off, to a second configuration, once the tear off seal is torn off, and wherein, in the first configuration, the second part acts on the first part to secure attachment of the first part to the plug thereby preventing separation of the first part from the plug, in the second configuration, the second part is releasable from the first part so that the first part is separable from the plug, the first part comprises axial attachment members configured to engage with the plug to constrain the first part to the plug along the axial direction and rotational attachment members configured to engage with the plug to constrain the first part to the plug rotationally around the axial direction.

2. The closure according to claim 1, wherein:

the first part comprises a top member surrounding a top portion of the plug, the axial attachment members and the rotational attachment members project from the top member along the axial direction to surround at least a middle portion of the plug, the middle portion of the plug being arranged between the top portion of the plug and a bottom portion of the plug, the bottom portion of the plug being configured to engage within the neck of the container.

3. The closure according to claim 1, wherein:

the axial attachment members comprise one or more tabs, each tab comprising one or more protrusions configured to penetrate at least partially into a side portion of the plug, the rotational attachment members comprise one or more axial ribs, each axial rib being configured to engage with a side portion of the plug.

4. The closure according to claim 1, wherein the second part comprises:

axial securing members configured to act, in the first configuration, on the axial attachment members to secure the axial attachment members to the plug, rotational securing members configured to act, in the first configuration, on the rotational attachment members to secure the rotational attachment members to the plug.

5. The closure according to claim 4, wherein:

the axial securing members comprise annular rib portions configured to act, in the first configuration, on annular groove portions formed on the tabs, the rotational securing members comprise tubular wall portions configured to act, in the first configuration, on the axial ribs.

6. The closure according to claim 1, wherein, once the tear off seal is torn off, action of the second part on the axial attachment members and the rotational attachment members is released.

7. The closure according to claim 1, wherein:

the first part surrounds at least a portion of the plug, the second part surrounds at least a portion of the first part.

8. The closure according to claim 1, wherein the first part is separated from the second part.

9. The closure according to claim 1, wherein:

the first part and the second part form a one piece element, upon tearing off the tear off seal, the second part separating from the first part.

10. A closure for a container having a neck with a pouring opening, the closure comprising:

a plug configured to engage within the neck to close the pouring opening, the plug extending along an axial direction, an overcap attached to the plug, wherein the overcap comprises:

a first part removably attached to the plug, a second part associated to the first part and configured to be grasped for opening and closing the container, the second part comprising a tear off seal configured to pass from a first configuration, before the tear off seal is torn off, to a second configuration, once the tear off seal is torn off, and wherein, in the first configuration, the second part acts on the first part to secure attachment of the first part to the plug thereby preventing separation of the first part from the plug, in the second configuration, the second part is releasable from the first part so that the first part is separable from the plug, before first opening of the container, the tear off seal is in the first configuration and remains in the first configuration after first opening of the container.

* * * * *